US005421631A

United States Patent [19]

Murray

[11] Patent Number: 5,421,631

[45] Date of Patent: Jun. 6, 1995

[54] PAIL BAILER

[76] Inventor: Joseph A. Murray, 116 Smokerise Dr., Warren, N.J. 07059-6821

[21] Appl. No.: 132,840

[22] Filed: Oct. 7, 1993

[51] Int. Cl.[6] ..... B65D 51/00

[52] U.S. Cl. ..... 294/68.22; 220/762

[58] Field of Search ..... 294/55, 66.1, 68.21, 294/68.22; 220/762, 776; 209/417–419

[56] References Cited

U.S. PATENT DOCUMENTS

| | | | |
|---|---|---|---|
| 565,763 | 8/1896 | Lowderbaugh | 294/68.22 |
| 979,380 | 12/1910 | Clay | 294/68.22 |
| 1,475,890 | 11/1923 | Schmuck | 220/762 X |
| 1,557,823 | 10/1925 | Frattallone | 294/68.22 |
| 1,574,809 | 3/1926 | Gilbreath | 294/68.22 |
| 2,698,198 | 12/1954 | Mulon | 294/68.22 |
| 2,785,826 | 3/1957 | Mappes | 220/762 |
| 2,997,797 | 8/1961 | Frankum, III | 294/68.22 X |
| 3,994,522 | 11/1976 | Hinshaw | 294/68.22 |

*Primary Examiner*—Dean J. Kramer
*Attorney, Agent, or Firm*—Salvatore C. Mitri

[57] ABSTRACT

There is disclosed a pail bailer having a continuous wall, an open top and a bottom that has a flood port formed therein and which is fitted with a flood screen and an internal flexible flapper valve overlying the flood port. The flapper valve is provided with a spacer bushing that permit it to flex away from the flood port when the pail bailer is lowered into water or other liquid to permit the water or other liquid to enter and fill the pail bailer. A handle is provided across the open top of the pail bailer and its ends are secured in diametrically opposed brackets enabling the handle to be rotated through an arc greater than 180° or be locked within the brackets in vertical, coaxial alignment with the longitudinal axis of the pail bailer.

11 Claims, 2 Drawing Sheets

PAIL BAILER

BACKGROUND OF THE INVENTION

This invention is directed to a pail bailer capable of quickly and efficiently withdrawing and removing water or other liquids from areas that are otherwise difficult to reach such as confined spaces and restricted areas.

Whenever water or other liquids need to be removed from a cellar or basement sump in a home or business building or from the bilge of small yachts or boats and the typical electrically powered or belt driven sump or bilge pump does not operate due to mechanical or power failure, a common water pail or bucket is typically used. To remove the water or other liquids from these areas, the bucket or pail has to be maneuvered to lie horizontally on its side so as to permit the water or other liquid to enter and fill it, whereupon it can be pulled up out of the sump or bilge and be emptied.

If the area of the sump or bilge is large enough and there is ample space surrounding it to permit a typical pail or bucket to be maneuvered in this manner, there is no problem. However, where the area of the sump or bilge is restricted such that a typical pail or bucket can not be maneuvered to lie on its side and become filled with the water or other liquid, the pail or bucket must then somehow be forced downward into the sump or bilge while the pail or bucket is in its normal, up-right or vertical position. This is difficult to accomplish as great effort and force must be expended to push the empty pail or bucket downward against the upward buoyancy force of the water or liquid. Where the level of water or other liquid to be reached is too far below the opening of the sump or bilge and/or is beyond a normal arm's length in a sump or bilge having such a restricted area, the difficulty of its removal using this technique becomes compounded.

An additional problem is confronted when the sump or bilge is located in a confined space making it difficult, if not impossible, to maneuver the pail or bucket from its normally vertical position to a horizontal position on its side in the sump or bilge to permit water or other liquid to enter and fill it.

SUMMARY OF THE INVENTION

It has now been found that water or liquid can be readily and easily withdrawn from a sump or bilge by using the pail bailer of this invention. Regardless of whether the area of the sump or bilge is restricted or whether the space surrounding the sump or bilge is confined or the water level in the sump or bilge is beyond an arm's reach, the pail bailer of the invention need only be lowered in its normally vertical and upright position into the sump or bilge and be filled with the water or liquid to be removed while in this position. The pail bailer of the invention can also be used to fetch water from over the side of a yacht or boat.

In general, the pail bailer of the invention comprises: a body portion having a continuous wall, an open top and a bottom; a flood port formed in said bottom; a flood screen overlying the entire cross-sectional area of said flood port; a flexible flapper valve contiguous to and overlying said flood port in a normally closed position; means to permit said flapper valve to flex to an open position when said pail bailer is lowered into water or other liquid; and, a handle secured to said wall adjacent to and spanning said open top.

The continuous wall of the pail bailer can be of any desired geometric shape and cross-section such as square, rectangular, conical, cylindrical, oval, and the like, and can be fabricated from any suitable material such as moldable plastics or metal such as galvanized steel or combinations of plastics and metal.

Also, the pail bailer of the invention can be made to be of any desired size to contain a volume ranging from about 5 to about 10 gallons or more for use in commercial or business sumps or a volume ranging from about 1 to about 5 gallons or less for use in residential sumps or the bilges of yachts or boats.

The flood screen of the pail bailer is preferably a plastic, wire or metal screen having a mesh size sufficient to permit water or other liquid to freely flow through it and yet small enough to block out large particles of dirt or other debris that may be in the water or liquid.

The flexible flapper valve is preferably fabricated from rubber or neoprene or from a moldable or thermoformable plastic such polyethylene, polysulfone, polyvinylsulfone, or the like, and is of a size that permits it to completely overly and cover the flood port when in a normal, at rest and closed position and which has a thickness that permits it to readily flex upwardly away from the flood port to admit water or other liquid into the pail bailer when the pail bailer is lowered into the water or other liquid.

In a preferred embodiment, the ends of the handle are mounted in opposed brackets provided on the exterior surface of the continuous wall adjacent the open top of the pail bailer. The brackets, in turn, are provided with means that permit the handle to be freely rotated through an arc of more than about 180° across the open top when the handle ends are in an unlocked position but which secure the handle in a vertical up-right position in coaxial alignment with the longitudinal axis of the pail bailer when the handle ends are engaged in a locking position within the brackets.

In a further preferred embodiment, a portion of the continuous wall adjacent the open top is recessed or indented from the remainder of the continuous wall an amount sufficient for the brackets and the ends of the handle to lie within the cross-sectional plane of the bottom of the pail bailer. With this construction, pail bailers having a cross-sectional dimension that permits them to be freely lowered can be easily operated in sumps or bilges that have very restricted areas.

DETAILED DESCRIPTION OF THE INVENTION

The pail bailer of the invention will become more apparent from the ensuing description when considered together with the accompanying drawing which illustrates preferred embodiments thereof wherein like reference numerals denote like parts and wherein.

Figure 1:
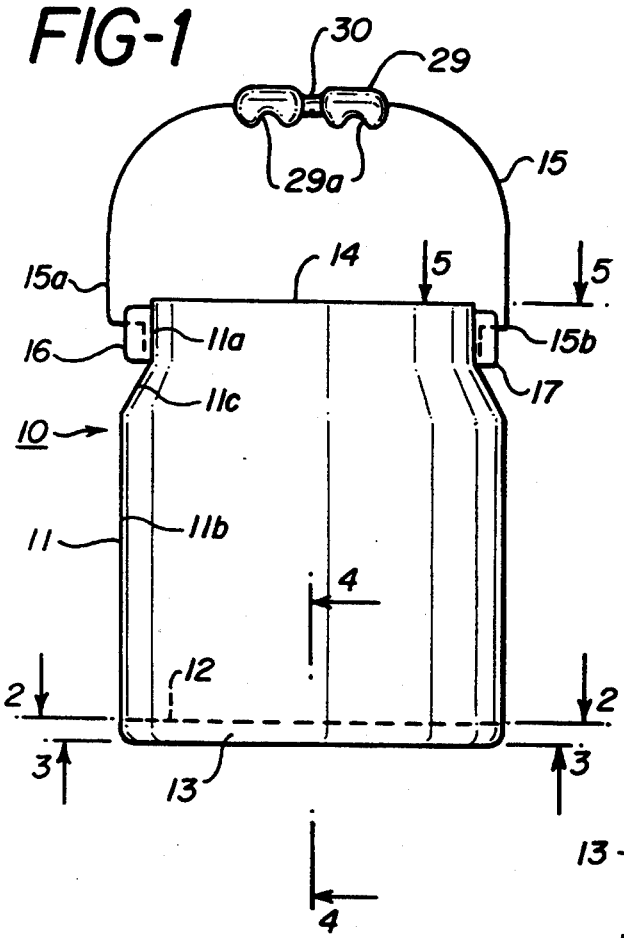
FIG. 1 is an elevation view of the pail bailer of the invention.

As illustrated in FIG. 1, the pail bailer of the invention generally identified by reference numeral 10 comprises a continuous body portion 11, a bottom 12, a circumferential skirt 13 extending downwardly from the bottom, an open top 14, an arcuate handle 15 and diametrically opposed brackets 16 and 17 that receive the ends of handle 15 in a manner described in more detail herein below.

Although the body portion 11 of pail bailer 10 can be of any desired geometric shape and cross section (e.g., cylindrical, conical, square, rectangular, oval, and the like) it is preferably cylindrical having an upper cylindrical wall 11 a whose circumference is less than that of its lower cylindrical wall 11*b*, upper wall 11*a* being joined to lower wall 11*b* by section 11*c*. By indenting upper wall 11*a* from lower wall 11*b* in this manner, arcuate handle 15 as well as brackets 16 and 17 can be retained within the circumferential plane of lower wall 11*b* and bottom 12 enabling the pail bailer 10 to be used without obstruction in restricted areas or confined spaces.

Figure 2:
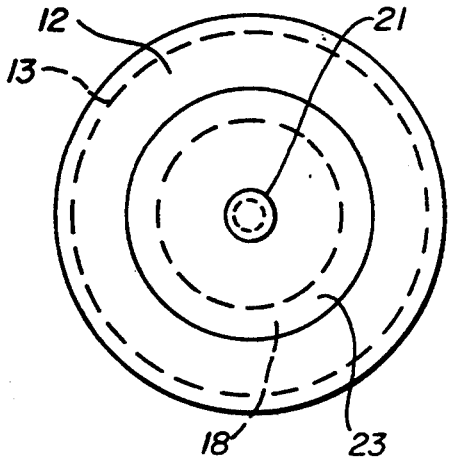
FIG. 2 is a view taken on the line 2—2 of FIG. 1.
Figure 3:
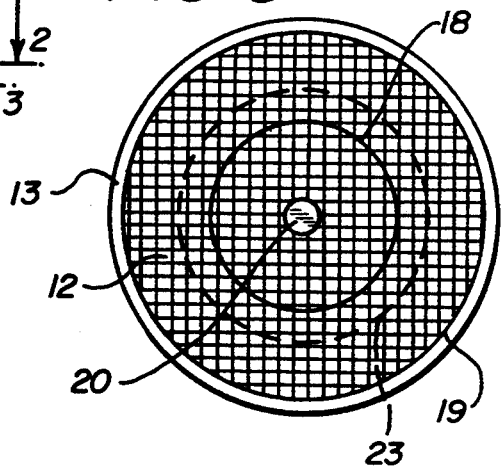
FIG. 3 is a view taken on the line 3—3 of FIG. 1.
Figure 4:
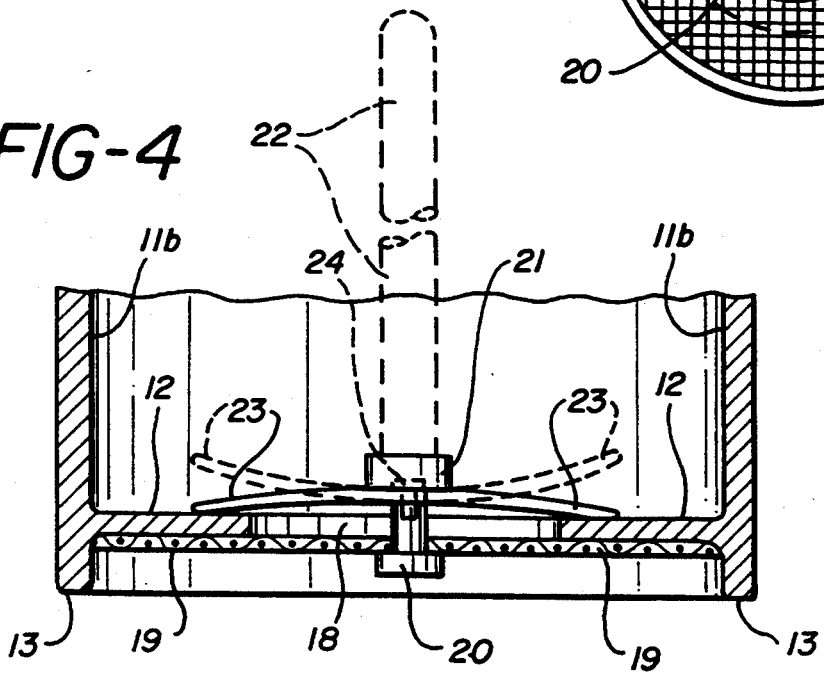
FIG. 4 is an enlarged sectional view taken on the line 4—4 of FIG. 1.

As shown in FIGS. 2, 3 and 4, a centrally positioned flood port 18 is provided in the bottom 12 of the pail bailer in the form of an enlarged, circular aperture. The diameter of the flood port 18 can be from about $\frac{1}{3}$ to about $\frac{3}{4}$ the diameter of the bottom 12 and is the means through which water or other liquid enters the body of the pail bailer. A flood screen 19 is secured to and overlays the entire outer surface of bottom 12. Flood screen 19 can be a plastic wire mesh or wire cloth of a size suitable to prevent large particles or debris from entering the pail bailer during use and can be secured to bottom 12 by conventional means such as by bolts or screws or the like. Preferably, flood screen 19 is provided from 9-gauge wire having a diameter of about 1/32" to form a mesh of about $\frac{1}{2}$".

As also shown in FIGS. 2–4, a spacer bushing 20 is secured by conventional means to the center of flood screen 19. Spacer bushing 20 protrudes upwardly into the body of the pail bailer 10 and is preferably fitted with a U-shaped cup member 21 at its upper end to receive a pole or rod indicated by dashed line 22.

A flexible flapper valve 23 (FIGS. 2–4) completely overlies flood port 18 in contiguous relationship and is secured to the top of spacer bushing 20 by conventional means such as bolt 24 so that flapper valve 23 is positioned between the top of spacer bushing 20 and the bottom of cup member 21. Preferably, a bushing or washer is provided between the upper face of flapper valve 23 and the bottom of cup member 21 to prevent flapper valve 23 from contacting or being impinged in any manner by the bottom of cup member 21. In its normal, at rest position or after the pail bailer has been filled with water, flapper valve 23 is in a normally closed position overlying and sealing flood port 18 as shown in solid lines in FIG. 4. When the pail bailer is being filled with water, flapper valve 23 is forced to flex upward and away from flood port 18 as shown in dashed lines in FIG. 4 to permit water to freely enter the pail bailer through the unsealed flood port 18. After the pail bailer has been filled to the desired level and arcuate handle 15 is pulled upward, the weight and downward force of the water or liquid in the pail bailer forces flapper valve 23 to flex downward to close and seal the flood port 18.

Figure 5:
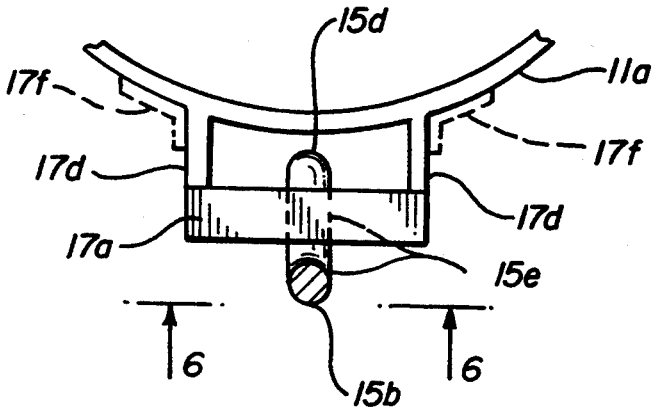
FIG. 5 is an enlarged view of the bracket means taken on the line 5—5 of FIG. 1.
Figure 6:
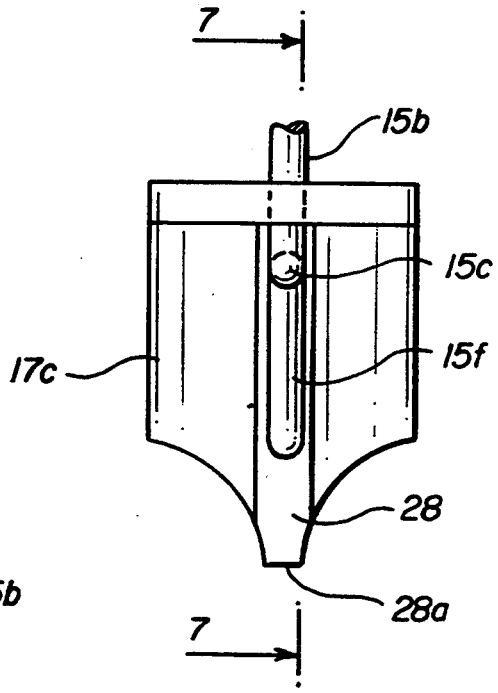
FIG. 6 is a view taken on the line 6—6 of FIG. 5.
Figure 7:
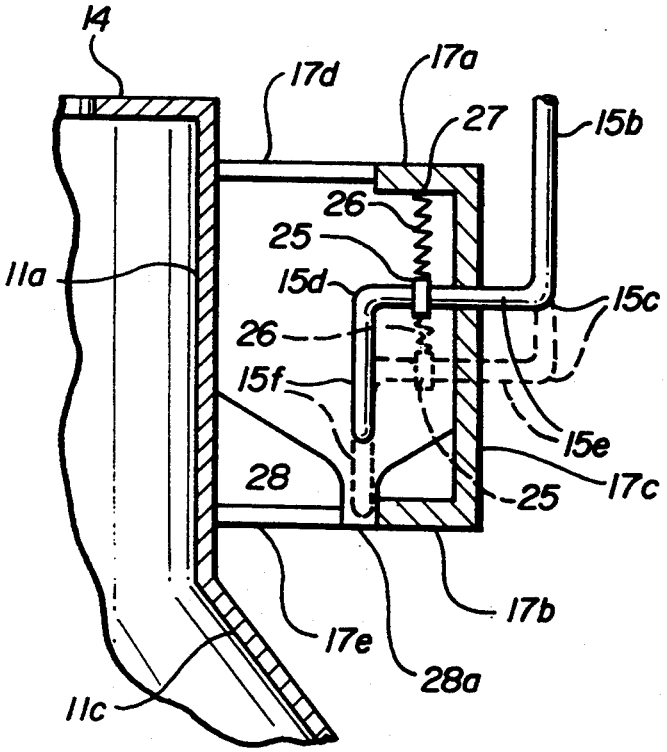
FIG. 7 is an enlarged view taken on the line 7—7 of FIG. 6.

With reference to FIGS. 1 and 7, it can be seen that the opposed ends 15*a* and 15*b* of arcuate handle 15 are each formed in the same way and are received in brackets 16 and 17 in the same manner. As shown in FIGS. 5–7, bracket 17 has opposed top and bottom walls 17*a* and 17*b*, respectively, and an outer wall 17*c*. Bracket 17 can be secured to upper wall 11*a* by means of upper and lower connecting arms 17*d* and 17*e*, respectively, which can be of unitary construction with the pail bailer when it is formed from plastic. When metal construction is used, connecting arms 17*d* and 17*e* can be secured to upper wall 11*a* by means of L-shaped connectors 17*f* (shown in dashed lines) using conventional means.

Arcuate handle end 15*b* has two angular bends 15*c* and 15*d*, both of which are preferably 90° angles, a horizontal run 15*e* between angular bends 15*c* and 15*d* and a vertically disposed end segment 15*f*. Horizontal run 15*e* is fitted with a retaining ring or washer 25. One end of a spring member 26 is secured to the retaining ting or washer 25 and its other end is anchored by conventional means to the inside of top wall 17*a* as indicated at 27. The lower portion of bracket 17 is tapered to form a V-shaped groove 28 which receives vertical end segment 15*f* therein in a close fitting relationship when arcuate handle 15 is manually pushed downward upon forcing the bottom 12 of the pail bailer into water or liquid. Preferably, an aperture 28*a* is formed through bottom wall 17*b* at the apex of V-shaped groove 28 to provide a drainage port within bracket 17.

This assemblage enables arcuate handle 15 to be rotated about the plane of horizontal run 15*e* through an arc of more than about 180° without the end of vertical segment 15*f* engaging the open end of V-groove 28. When arcuate handle 15 is in a vertical position and in coaxial alignment with the longitudinal axis of the pail bailer as shown in FIG. 1 and the pail bailer has been lowered to contact the water or liquid in a sump or bilge, arcuate handle 15 can then be manually pushed downward toward open top 14 whereupon vertical segment 15*f* is forced downward against the biasing of spring 26 and into V-shaped groove 28 as shown in broken lines in FIG. 7 to lock arcuate handle 15 in its vertical position. When manual downward pressure is thus exerted on arcuate handle 15 locking vertical segment 15*f* in V-shaped groove 28, arcuate handle 15 is prevented from rotating so that the pail bailer and arcuate handle 15 can function as a single, rigid unit enabling the pail bailer to be readily lowered into restricted sump or bilge areas. After water or other liquid begins to fill the pail bailer, the manual downward pressure on arcuate handle 15 can be released to permit handle end 15*b* and spring 26 to return to their normal positions within bracket 17 as shown in solid lines in FIG. 7.

Arcuate handle 15 is also provided with a handle grip 29 (FIG. 1) intermediate its ends 15*a*, 15*b*, preferably at its center. Handle grip 29 can be fabricated to have finger grips 29*a* to facilitate using the pail bailer. Preferably, an annular recess 30 is formed intermediate the ends of handle grip 29 so that a line or rope can be secured about annular recess 30 to prevent the line or rope from slipping and enable the pail bailer to be lowered into areas too deep to reach manually. After the pail bailer has been filled with the water or liquid to be removed, it can be pulled up using the line or rope secured to the annular recess 30.

To further facilitate lowering and guiding the pail bailer into deep areas, a pole or rod 22 of sufficient length can be inserted into cup member 21 as illustrated by broken lines in FIG. 4 together with a line or rope secured about annular recess 30. Using the pole or rod 22, the pail bailer can then be thrust downward into the water or liquid forcing the flapper valve 23 to open and rapidly fill the pail bailer with the water or liquid to be removed. As the pail bailer begins to fill with water or liquid, the pole 22 can be removed, the pail bailer can be retrieved using the line or rope as described above and can then be emptied by grasping the circumferential skirt 13 to invert it. Circumferential skirt 13 also protects the bottom 12 of the pail bailer by preventing the bottom 12 from contacting other fiat surfaces.

Although preferred embodiments of the pail bailer of the invention have been described with particularity and in detail, it should be understood that changes and modifications can be made therein without departing from the scope of the invention defined in the claims.

What is claimed is:

1. A pail bailer comprising:

(a) a body portion having a continuous wall, an open top and a bottom;

(b) a flood port formed in the center of said bottom;

(c) a flood screen overlying the entire cross-sectional area of said flood port;

(d) a flexible flapper valve contiguous to and overlying said flood port in a normally closed position;

(e) a centrally positioned flapper valve mounting means to which said flapper valve is secured such that said flapper valve is capable of flexing to an open position when said pail bailer is lowered into water or other liquid, said flapper valve mounting means comprising a spacer bushing centrally secured to said flood screen, said spacer bushing protruding upwardly from said flood screen into said body portion and said flapper valve being secured to the top of said spacer bushing: and, (f) a U-shaped cup member secured to said spacer bushing above said flapper valve such that said U-shaped cup member does not contact said flapper valve.

2. The pail bailer of claim 1 wherein said body portion is a cylindrical wall and is provided with a pair of opposed brackets secured adjacent to said open top; and, an arcuate handle, the opposed ends of which are rotatably mounted in said opposed brackets.

3. The pail bailer of claim 2 wherein that portion of said cylindrical wall to which said brackets are secured is indented from the remainder of said cylindrical wall an amount sufficient for said brackets and the ends of said handle to lie within the circumferential plane of said bottom.

4. The pail bailer of claim 2 wherein said brackets are provided with means to lock the ends of said handle therein such that said handle can be secured in vertical, coaxial alignment with the longitudinal axis of said body portion.

5. The pail bailer of claim 2 wherein a handle grip is mounted intermediate the ends of said arcuate handle and said handle grip has an annular groove and finger grips defined therein intermediate its ends.

6. The pail bailer of claim 1 which includes a circumferential skirt extending downwardly from said bottom.

7. A pail bailer comprising:

(a) a continuous cylindrical body wall having an open top and a bottom;

(b) a flood port centrally formed in said bottom;

(c) a flood screen secured to and overlying the entire cross-sectional area of said bottom;

(d) a spacer bushing secured to the center of said flood screen and protruding upwardly within said body wall;

(e) a flexible flapper valve secured to the top of said spacer bushing, said flapper valve being contiguous to and overlying said flood port in a normally closed position;

(f) a pair of diametrically opposed brackets secured to the outer surface of said body wall adjacent said open top;

(g) an arcuate handle, the opposed ends of which are rotatably mounted in said opposed brackets; and, (h) means within said brackets to lock the ends of said handle therein such that said handle can be secured in vertical, coaxial alignment with the longitudinal axis of said cylindrical body wall enabling said handle and said cylindrical body to function as a single rigid unit.

8. The pail bailer of claim 7 wherein that portion of said cylindrical body wall to which said brackets are secured is indented from the remainder of said cylindrical body wall an amount sufficient for said brackets and the ends of said handle to lie within the circumferential plane of said bottom.

9. The pail bailer of claim 7 wherein a handle grip is mounted intermediate the ends of said arcuate handle and said handle grip has an annular groove and finger grips formed therein intermediate its ends.

10. The pail bailer of claim 7 wherein a U-shaped cup member is secured to said spacer bushing above said flapper valve such that said U-shaped cup member does not contact said flapper valve.

11. The pail bailer of claim 7 which includes a circumferential skirt extending downwardly from said bottom.

* * * * *